US009038783B2

(12) United States Patent
Roberts et al.

(10) Patent No.: US 9,038,783 B2
(45) Date of Patent: May 26, 2015

(54) ROPE SWAY MITIGATION VIA ROPE TENSION ADJUSTMENT

(75) Inventors: Randall Keith Roberts, Hebron, CT (US); Mark R. Gurvich, Middletown, CT (US); Richard N. Fargo, Plainville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 668 days.

(21) Appl. No.: 13/387,595

(22) PCT Filed: Jul. 29, 2009

(86) PCT No.: PCT/US2009/052054

§ 371 (c)(1),
(2), (4) Date: Jan. 27, 2012

(87) PCT Pub. No.: WO2011/014165

PCT Pub. Date: Feb. 3, 2011

(65) Prior Publication Data

US 2012/0125720 A1 May 24, 2012

(51) Int. Cl.

| | |
|---|---|
| ***B66B 7/10*** | (2006.01) |
| ***B66B 7/06*** | (2006.01) |
| ***B66B 7/08*** | (2006.01) |

(52) U.S. Cl.
CPC .. *B66B 7/068* (2013.01); *B66B 7/08* (2013.01)

(58) Field of Classification Search
CPC .... B66B 5/0018; B66B 5/0031; B66B 5/022; B66B 5/12; B66B 5/185; B66B 5/24
USPC ..... 187/247, 250, 251, 254, 256, 258, 264, 187/277, 278, 391, 393, 411–414; 182/142, 182/144, 150
See application file for complete search history.

(56) References Cited

U.S. PATENT DOCUMENTS

| | | | | | |
|---|---|---|---|---|---|
| 4,106,594 | A | * | 8/1978 | Kirsch et al. | 187/278 |
| 4,230,205 | A | * | 10/1980 | Darwent | 187/265 |
| 4,522,285 | A | * | 6/1985 | Salmon et al. | 187/264 |
| 5,861,084 | A | * | 1/1999 | Barker et al. | 187/264 |
| 6,065,569 | A | * | 5/2000 | Fuller | 187/345 |

(Continued)

FOREIGN PATENT DOCUMENTS

| | | |
|---|---|---|
| JP | 315138 | 6/1931 |
| JP | 5323448 A | 3/1978 |

(Continued)

OTHER PUBLICATIONS

Translation JP 2008-308240.*

(Continued)

*Primary Examiner* — Anthony Salata
(74) *Attorney, Agent, or Firm* — Cantor Colburn LLP

(57) ABSTRACT

A rope sway mitigation device for an elevator system includes a rope tension adjuster connected to a plurality of ropes operably connected to an elevator car. The rope tension adjuster is configured to adjust a tension of at least one individual rope of the plurality of ropes thereby mitigating excitation of natural frequencies of the plurality of ropes during sway of at least one component of the elevator system and or a building in which the elevator system is located. Further disclosed is an elevator system including a rope sway mitigation device and a method of rope sway mitigation in an elevator system.

20 Claims, 2 Drawing Sheets

(56) References Cited

U.S. PATENT DOCUMENTS

| | | | | |
|---|---|---|---|---|
| 6,315,084 | B1 * | 11/2001 | Shon | 187/411 |
| 6,488,125 | B1 * | 12/2002 | Otsuka et al. | 187/264 |
| 7,117,978 | B2 * | 10/2006 | Kaczmarek et al. | 187/276 |
| 7,793,763 | B2 * | 9/2010 | Zhu et al. | 187/411 |
| 8,123,002 | B2 * | 2/2012 | Smith et al. | 187/393 |
| 8,256,582 | B2 * | 9/2012 | Qiu | 187/406 |
| 2014/0124300 | A1 * | 5/2014 | Benosman | 187/247 |
| 2014/0182976 | A1 * | 7/2014 | Valjus et al. | 187/254 |

FOREIGN PATENT DOCUMENTS

| | | | |
|---|---|---|---|
| JP | 5319739 | A | 12/1993 |
| JP | 11209032 | A | 8/1999 |
| JP | 2004001912 | A | 1/2004 |
| JP | 2008308240 | A | 12/2008 |
| KR | 20090034820 | A | 4/2009 |
| WO | 2009/036423 | A2 | 3/2009 |

OTHER PUBLICATIONS

Notification of Transmittal of the International Search Report and the Written Opinion of the International Searching Authority; PCT/US2009/052054; Korean Intellectual Property Office, Mailed Apr. 6, 2010; 11 pages.

* cited by examiner

ROPE SWAY MITIGATION VIA ROPE TENSION ADJUSTMENT

This is a U.S. national stage application of International Application No. PCT/US2009/052054, filed on 29 Jul. 2009, the disclosure of which is also incorporated herein by reference.

BACKGROUND OF THE INVENTION

The subject matter disclosed herein relates to elevator systems. More specifically, the subject matter relates to sway mitigation of ropes of elevator systems.

During periods of, for example, high velocity winds, buildings tend to sway laterally. As a building sways, lateral motion of the building typically translates into lateral motion of ropes and cables of elevator systems installed in the building. The lateral motion of the ropes and cables can result in noise, wear, and/or damage to elevator system equipment and/or the building.

Typically, one of several approaches are utilized to mitigate rope sway issues. The first uses mechanical means to restrain the ropes to limit rope sway. Such devices include cab followers and swing arms as described, for example, in U.S. Pat. No. 5,947,232. Such mechanical devices are potentially effective to limit rope sway, but are costly and take up space in the hoistway.

A second approach typically involves limiting elevator car operations during periods of building sway. This involves a sensor added to the elevator system which detects building sway. When sway exceeds a preset limit, a set of alternate control instructions are placed on the elevator system to, for example, reduce operating speed of the elevator and/or to restrict parking access of the elevator car at floors where rope sway is likely to occur.

BRIEF DESCRIPTION OF THE INVENTION

According to one aspect of the invention, an elevator system includes an elevator car connected to a plurality of ropes and a sway detection sensor configured to detect sway of at least one component of the elevator system and/or a building in which the elevator system is located. A rope tension adjuster is connected to the sway detection sensor and is configured to adjust a tension of at least one individual rope of the plurality of ropes to mitigate excitation of natural frequencies of the plurality of ropes when the sway detection sensor detects sway of the building.

According to another aspect of the invention, a rope sway mitigation device for an elevator system includes a rope tension adjuster connected to a plurality of ropes operably connected to an elevator car. The rope tension adjuster is configured to adjust a tension of at least one individual rope of the plurality of ropes thereby mitigating excitation of natural frequencies of the plurality of ropes during a sway of at least one component of the elevator system and/or a building in which the elevator system is located.

According to yet another aspect of the invention, a method of rope sway mitigation in an elevator system includes detecting sway of at least one component of the elevator system and/or a building in which the elevator system is located. A tension of a plurality of ropes connected to the elevator car is adjusted in response to detection of the sway to mitigate excitation of natural frequencies of the plurality of ropes thereby preventing sway of the plurality of ropes.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
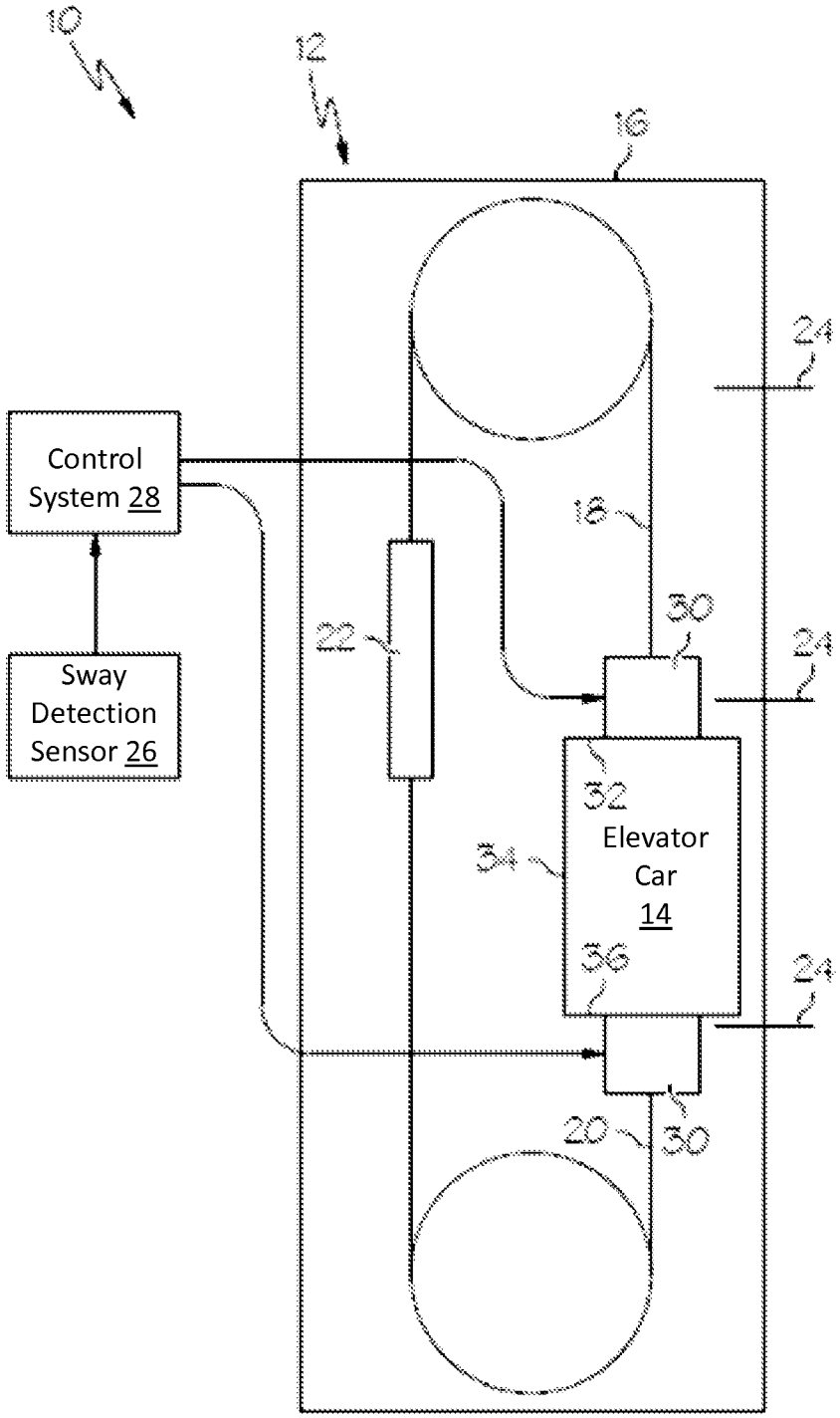
FIG. 1 is an illustration of an embodiment of an elevator system.

Shown in FIG. 1 is an illustration of an elevator system 10 disposed in a building 12. An elevator car 14 is positioned in a hoistway 16 by a plurality of ropes including a plurality of suspension ropes 18 extending substantially upward from the elevator car 14 and, in some embodiments, by a plurality of compensation ropes 20 extending substantially downward from the elevator car 14 connected to a counterweight 22. The hoistway 16 includes a plurality of landing locations 24 for the elevator car 14. In some embodiments, the elevator system 10 includes a sway detection sensor 26 which may be, for example, a pendulum switch, accelerometer, anemometer, or the like configured to detect, directly (from, for example, building motion) and/or indirectly (from, for example, wind speed), sway of the building 12 and/or sway of the plurality of suspension ropes 18 and/or the plurality of compensation ropes 20. Sway of the plurality of suspension ropes 18 and/or the plurality of compensation ropes 20 depends on the proximity of the building 12 sway frequency to a natural frequency of the pluralities of ropes 18, 20. The building 12 sway frequency is fairly constant and can be estimated for a particular building 12 based on its structural design. The building 12 sway frequency typically is in the range of 0.1-0.2 Hz. One or more modes of rope 18, 20 frequency, when the rope 16 frequency modes are integer multiples of the building 12 sway frequency, can be excited by the building 12 sway frequency. Given a layout of an elevator system 10 in a building 12, it is possible to determine at which landing locations 24 the pluralities of ropes 18, 20 will have frequency modes which will be excited by the building 12 sway frequency.

When the sway detection sensor 26 detects building 12 sway which may excite one or more modes in the plurality of suspension ropes 18 and/or the plurality of compensation ropes 20, a signal is sent from the sway detection sensor 26 to a control system 28 which determines a course of action. One course of action is to change tensions in individual ropes of the plurality of suspension ropes 18 and/or the plurality of compensation ropes 20 to place at least one individual rope above building 12 sway frequency and at least one individual rope below building 12 sway frequency. The total tension of the plurality of ropes is T. In normal conditions, the tension on each individual rope is approximately equal. For example, is an elevator system 10 utilizing five suspension ropes 18, individual suspension rope tensions, $T_i$, are approximately T/5 in normal operation. When tension $T_i$ produces vibratory frequencies close to the building 12 sway frequency, tensions in individual suspension ropes 18*a* through 18*e* are adjusted, for example, as shown in equations 1-5.

$$T_a=(T/5)-\Delta T_1 \quad (1)$$

$$T_b=(T/5)+\Delta T_2 \quad (2)$$

$$T_c=(T/5)-\Delta T_1 \quad (3)$$

$$T_d=(T/5)+\Delta T_2 \quad (4)$$

$$T_e=(T/5)-\Delta T_1 \quad (5)$$

In this example, $\Delta T_1$ equals ⅔ times $\Delta T_2$ so that the resultant total tension, T, remains constant. While this example illustrates an elevator system 10 including five suspension ropes 18, it is to be appreciated that elevator systems 10 utilizing other quantities of suspension ropes 18 and/or compensation ropes 20, for example between 2 and 12 or more suspension ropes 18 or compensation ropes 20, and/or tension adjustment values are contemplated within the present scope.

In operation, when the sway detection sensor 26 detects a building 12 sway event, a signal is sent from the sway detection sensor 26 to the control system 28. The control system 28 determines if the elevator car 14 is parked at a landing location 24 where the suspension rope 18 sway frequency or compensation rope 20 sway frequency will be excited by the building 12 sway, and if so communicates with a rope tension adjuster 30 to adjust the tension of the suspension ropes 18 and/or compensation ropes 20 accordingly. When the building 12 sway event has passed, the tensions of the suspension ropes 18 are returned to equal. In some embodiments, the sway detection sensor 26 may be configured to detect sway of individual suspension ropes 18 or groups of suspension ropes 18. When a sway of the suspension ropes 18 is detected, the tension adjuster 30 adjusts the tension of the swaying suspension ropes 18 until the sway is reduced by a desired amount.

Figure 2:
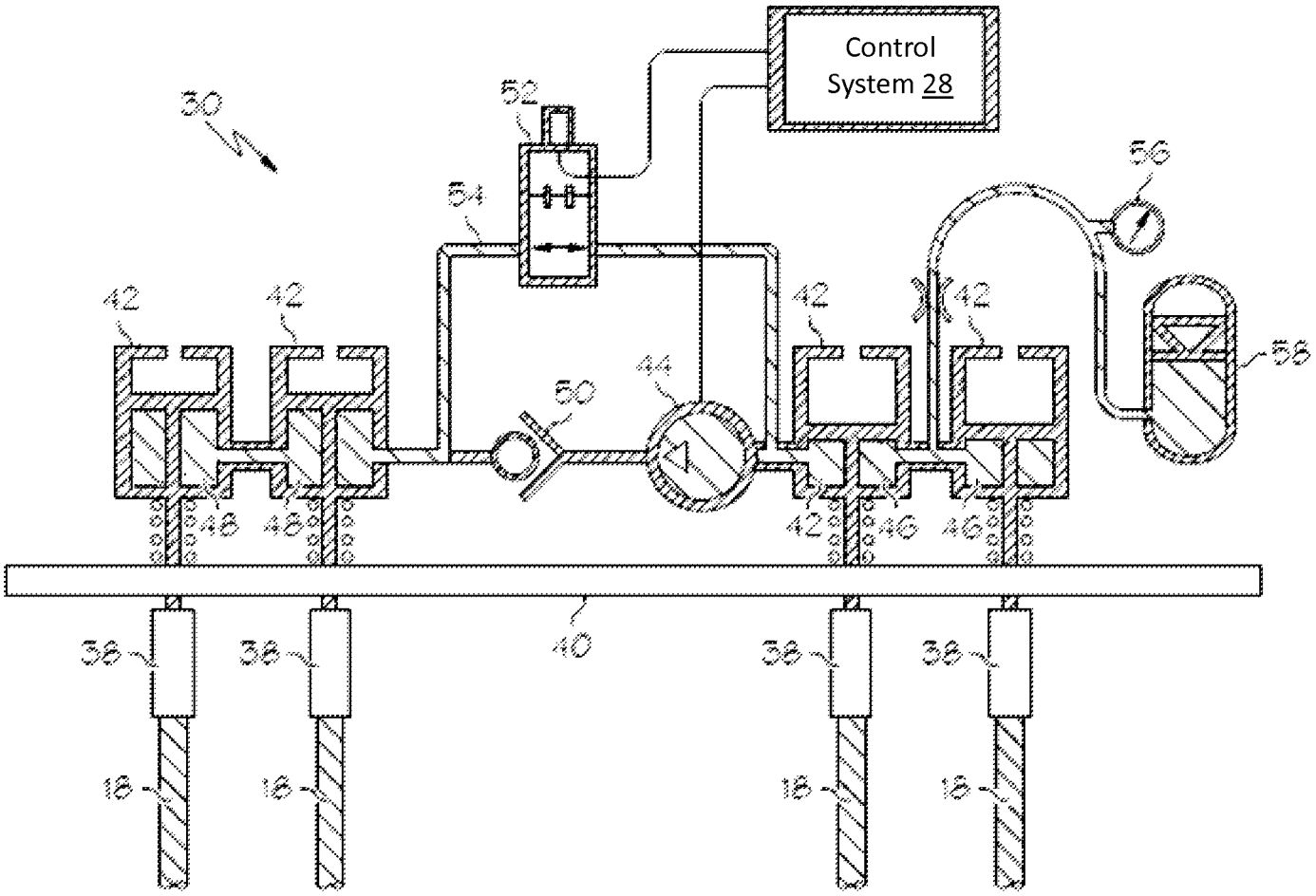
FIG. 2 is an illustration of an embodiment of a rope tension adjuster.

Each suspension rope 18 of the plurality of suspension ropes 18 is connected to a rope tension adjuster 30 disposed at the elevator car 14 Likewise, in some embodiments, each compensation rope 20 of the plurality of compensation ropes is connected to a rope tension adjuster 30 disposed at, for example, a bottom 36 of the elevator car 14. Embodiments of the rope tension adjuster 30 connected to the plurality of suspension ropes 18 will now be described by way of example, but it is to be appreciated that the same embodiments may be utilized in connection with the plurality of compensation ropes 20. As shown in FIG. 1, the plurality of suspension ropes 18 is connected to the rope tension adjuster 30 disposed at a top 32 of the elevator car 14, but in some embodiments the rope tension adjuster 30 may be disposed at other locations, for example a side 34 or a bottom 36 of the elevator car 14 or in the hoistway 18. Referring now to FIG. 2, a more detailed view of a rope tension adjuster 30 is illustrated. Each suspension rope 18 of the plurality of suspension ropes 18 are connected a termination 38 which passes through a hitch plate 40 and is connected to a plurality of hydraulic cylinders 42. The hydraulic cylinders 42 are connected to a pump 44 which is, in turn, connected to the control system 28. When activated, the pump 44 pumps additional fluid, for example, from a first group 46 of the hydraulic cylinders 42 into a second group 48 of the hydraulic cylinders 42. Increasing the fluid in the second group 48 of hydraulic cylinders 42 increases the tension of the suspension ropes 18 connected to the second group 48 of hydraulic cylinders 42 while decreasing the tension of the suspension ropes 18 connected to the first group 48 of hydraulic cylinders 42. The first group 46 and the second group 48 of hydraulic cylinders 42 may be separated by a one-way check valve 50 which is configured to allow fluid to be pumped from the first group 46 to the second group 48 but prevents fluid from flowing backward from second group 48 to the first group 46. In some embodiments, sway of the suspension ropes 18 may be detected via, for example, a pressure sensor (not shown) disposed at each hydraulic cylinder 42. A pressure variation at a particular hydraulic cylinder 42 would indicate sway of the corresponding suspension rope 30 and adjustment of the tension of the suspension rope 18 would be initiated.

Some embodiments of rope tension adjusters 30 include a solenoid valve 52 connected to the control system 28. The solenoid valve 52 is disposed between the first group 46 and second group 48 at, for example, a return conduit 54. Opening the solenoid valve 52 allows excess fluid to pass from the second group 48 to the first group 46 to equalize the pressure among the hydraulic cylinders 42 thus equalizing the tension on the plurality of suspension ropes 18. In some embodiments, the solenoid valve 52 is normally open during non-sway conditions. During a sway event, the solenoid valve is energized and closed. The pump 44 is switched on to pump fluid into the hydraulic cylinders 48 thereby increasing tension of the ropes 18 connected to the hydraulic cylinders 48. When the sway event is over, the solenoid valve 52 is reopened allowing the pressure to reequalize.

Some embodiments of the rope tension adjuster 30 may include a pressure sensor 56 connected to the hydraulic cylinders 42. The pressure sensor may be utilized to weigh a load on the elevator car 14 (FIG. 1) which may be utilized by the control system 28 to determine elevator car 14 operational settings. Further, some embodiments may include an accumulator 58 connected to the hydraulic cylinders 42. The accumulator 58 may be utilized to distribute fluid during normal operation to aid in damping vibration of the elevator car 14.

The embodiments of rope tension adjusters 30 described above are merely exemplary. While the embodiments utilize hydraulic cylinders 42 to adjust the tension of the plurality of suspension ropes 18 and/or the plurality of compensation ropes 20, other means, for example, mechanical linkage could be used to move the hitch plate 40 over a group of suspension ropes 18 and/or compensation ropes 20 thus effectively changing the tension on the suspension ropes 18 and/or compensation ropes 20.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator system comprising:

an elevator car having a plurality of ropes operably connected thereto;

a sway detection sensor configured to detect sway of at least one component of the elevator system and/or a building in which the elevator system is disposed; and a rope tension adjuster in operable communication with the sway detection sensor, the rope tension adjuster configured to increase a tension of at least one of the individual ropes of the plurality of ropes and to decrease a tension of at least one of the individual ropes of the plurality of ropes to mitigate excitation of natural frequencies of at least one of the plurality of ropes when the sway detection sensor detects sway of the at least one component of the elevator system and/or the building.

2. The elevator system of claim 1 wherein the rope tension adjuster increases tension on a first group of ropes of the plurality of ropes and decreases a tension on a second group of ropes of the plurality of ropes.

3. The elevator system of claim 1 wherein a total tension of the plurality of ropes remains substantially constant.

4. The elevator system of claim 1 wherein the rope tension adjuster comprises a plurality of hydraulic cylinders connected to the plurality of ropes.

5. The elevator system of claim 4 including a pump that urges fluid from a first group of hydraulic cylinders of the plurality of hydraulic cylinders to a second group of hydraulic cylinders of the plurality of hydraulic cylinders.

6. The elevator system of claim 5 wherein fluid pumped to the second group of hydraulic cylinders increases a tension of the ropes of the plurality of ropes connected thereto.

7. The elevator system of claim 5 wherein pumping fluid from the first group of hydraulic cylinders decreases a tension of the ropes of the plurality of ropes connected thereto.

8. The elevator system of claim 1 wherein the plurality of ropes comprise suspension ropes and/or compensation ropes.

9. A rope sway mitigation device for an elevator system comprising:

a rope tension adjuster connected to a plurality of ropes connected to an elevator car, the rope tension adjuster configured to increase a tension of at least one individual rope of the plurality of ropes and decrease a tension of at least one individual rope of the plurality of ropes thereby preventing excitation of natural frequencies of the plurality of ropes during a building sway event.

10. The rope sway mitigation device of claim 9 wherein the rope tension adjuster increases tension on a first group of ropes of the plurality of ropes and decreases a tension on a second group of ropes of the plurality of ropes.

11. The rope sway mitigation device of claim 9 wherein a total tension of the plurality of ropes remains substantially constant.

12. The rope sway mitigation device of claim 9 wherein the rope tension adjuster comprises a plurality of hydraulic cylinders connected to the plurality of ropes.

13. The rope sway mitigation device of claim 12 including a pump that urges fluid from a first group of hydraulic cylinders of the plurality of hydraulic cylinders to a second group of hydraulic cylinders of the plurality of hydraulic cylinders.

14. The rope sway mitigation device of claim 13 wherein fluid pumped to the second group of hydraulic cylinders increases a tension of the ropes of the plurality of ropes connected thereto.

15. The rope sway mitigation device of claim 13 wherein pumping fluid from the first group of hydraulic cylinders decreases a tension of the ropes of the plurality of ropes connected thereto.

16. The rope sway mitigation device of claim 12 including a solenoid valve configured to equalize tension on the plurality of ropes.

17. A method of rope sway mitigation in an elevator system comprising:

detecting sway of at least one component of the elevator system and/or a building in which the elevator system is disposed;

increasing tension of at least one of a plurality of ropes operably connected to an elevator car and decreasing tension of at least one of the plurality of ropes operably connected to the elevator car in response to detection of sway of the at least one component of the elevator system and/or the building; and mitigating excitation of natural frequencies of the plurality of ropes via the tension adjustment thereby preventing sway of the plurality of ropes.

18. The method of rope sway mitigation of claim 17 comprising increasing a tension on a first group of ropes of the plurality of ropes and decreasing a tension on a second group of ropes of the plurality of ropes.

19. The method of rope sway mitigation of claim 17 comprising urging hydraulic fluid into a first group of hydraulic cylinders connected to a first group of ropes of the plurality of ropes thereby increasing a tension on the first group of ropes and decreasing a tension on a second group of ropes of the plurality of ropes.

20. The method of rope sway mitigation of claim 19 comprising:

detecting an end of the sway of the at least one component of the elevator system and/or the building; and urging hydraulic fluid away from the first group of hydraulic cylinders thereby equaling tension of individual ropes of the plurality of ropes.

* * * * *